US010323485B2

(12) United States Patent
Theodossiou

(10) Patent No.: US 10,323,485 B2
(45) **Date of Patent: *Jun. 18, 2019**

(54) PRESSURE EXCHANGER SYSTEM WITH INTEGRAL PRESSURE BALANCING SYSTEM

(71) Applicant: Energy Recovery, Inc., San Leandro, CA (US)

(72) Inventor: Alexander Theodossiou, San Francisco, CA (US)

(73) Assignee: Energy Recovery, Inc., San Leandro, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/914,144

(22) Filed: Mar. 7, 2018

(65) Prior Publication Data

US 2018/0195370 A1 Jul. 12, 2018

Related U.S. Application Data

(63) Continuation of application No. 14/819,229, filed on Aug. 5, 2015, now Pat. No. 9,945,210.

(51) Int. Cl.

| | |
|---|---|
| ***F04F 13/00*** | (2009.01) |
| ***E21B 41/00*** | (2006.01) |
| ***E21B 43/26*** | (2006.01) |
| ***E21B 43/267*** | (2006.01) |

(52) U.S. Cl.

CPC ..... *E21B 41/00* (2013.01); *E21B 43/26* (2013.01); *E21B 43/267* (2013.01); *F04F 13/00* (2013.01)

(58) Field of Classification Search

CPC ..... E21B 41/00; E21B 43/26; E21B 43/267; F04F 13/00

USPC ..... 417/64

See application file for complete search history.

(56) References Cited

U.S. PATENT DOCUMENTS

| | | | | |
|---|---|---|---|---|
| 3,431,747 | A | 3/1969 | Hashemi et al. | |
| 4,274,811 | A | 6/1981 | Rao | |
| 4,352,638 | A | 10/1982 | Valiance | |
| 4,471,795 | A | 9/1984 | Linhardt | |
| 9,945,210 | B2 * | 4/2018 | Theodossiou | E21B 41/00 |
| 2002/0146325 | A1 | 10/2002 | Shumway | |
| 2006/0032808 | A1 | 2/2006 | Hauge | |
| 2009/0180903 | A1 | 7/2009 | Martin et al. | |
| 2013/0294944 | A1 | 11/2013 | Hirosawa et al. | |
| 2014/0048143 | A1 | 2/2014 | Lehner et al. | |

OTHER PUBLICATIONS

PCT International Search Report and Written Opinion; Application No. PCT/US2015/043858; Dated Nov. 24, 2015; 14 pages.

* cited by examiner

*Primary Examiner* — Charles G Freay
(74) *Attorney, Agent, or Firm* — Fletcher Yoder P.C.

(57) ABSTRACT

A system includes a rotary isobaric pressure exchanger (IPX) configured to exchange pressures between a first fluid and second fluid. The rotary IPX includes a first end cover including a first fluid aperture configured to route the first fluid. The rotary IPX also includes a first piston coupled to the first end cover. The first piston includes a first hydraulic path configured to route the first fluid to or from the first fluid aperture.

20 Claims, 4 Drawing Sheets

PRESSURE EXCHANGER SYSTEM WITH INTEGRAL PRESSURE BALANCING SYSTEM

CROSS REFERENCE TO RELATED APPLICATION

This application is a continuation of U.S. patent application Ser. No. 14/819,229, entitled "Pressure Exchanger System with Integral Pressure Balancing System," filed Aug. 5, 2015, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

The subject matter disclosed herein relates to fluid handling equipment such as hydraulic fracturing equipment.

Well completion operations in the oil and gas industry often involve hydraulic fracturing (often referred to as fracking or fracing) to increase the release of oil and gas in rock formations. Hydraulic fracturing involves pumping a fluid containing a combination of water, chemicals, and proppant (e.g., sand, ceramics) into a well at high pressures. The high-pressures of the fluid increases crack size and propagation through the rock formation releasing more oil and gas, while the proppant prevents the cracks from closing once the fluid is depressurized. Fracturing operations use high-pressure pumps to increase the pressure of the frac fluid. Unfortunately, certain components of the fluid handling equipment may be exposed to fluids with differing pressure, which may cause a pressure imbalance across the respective components.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, a hydraulic energy transfer system enables the transfer of work and/or pressure between first and second fluids, such as a pressure exchange fluid (e.g., a substantially proppant free fluid, such as water) and a hydraulic fracturing fluid (e.g., a proppant-laden frac fluid). In some embodiments, the hydraulic energy transfer system may be a rotating isobaric pressure exchanger (IPX) that transfers pressure between a high pressure first fluid (e.g., pressure exchange fluid, such as a first proppant free or substantially proppant free fluid) and a low pressure second fluid that may be highly viscous and/or contain proppant (e.g., frac fluid containing sand, solid particles, powders, debris, ceramics). In operation, certain components of the rotary IPX, such as the end covers, may be exposed to the high pressure first fluid and the low pressure second fluid, which may create a pressure imbalance across the respective components. Unfortunately, the pressure imbalance may cause deflection of the components (e.g., the end covers), which may enable the first and second fluids to mix outside of the rotor. As described in more detail below, the disclosed embodiments provide one or more pistons integral with one or more end covers of the IPX that create sealed off pressure areas to balance the forces acting on the end covers, which may reduce or minimize the deflection of the end covers.

Figure 1:
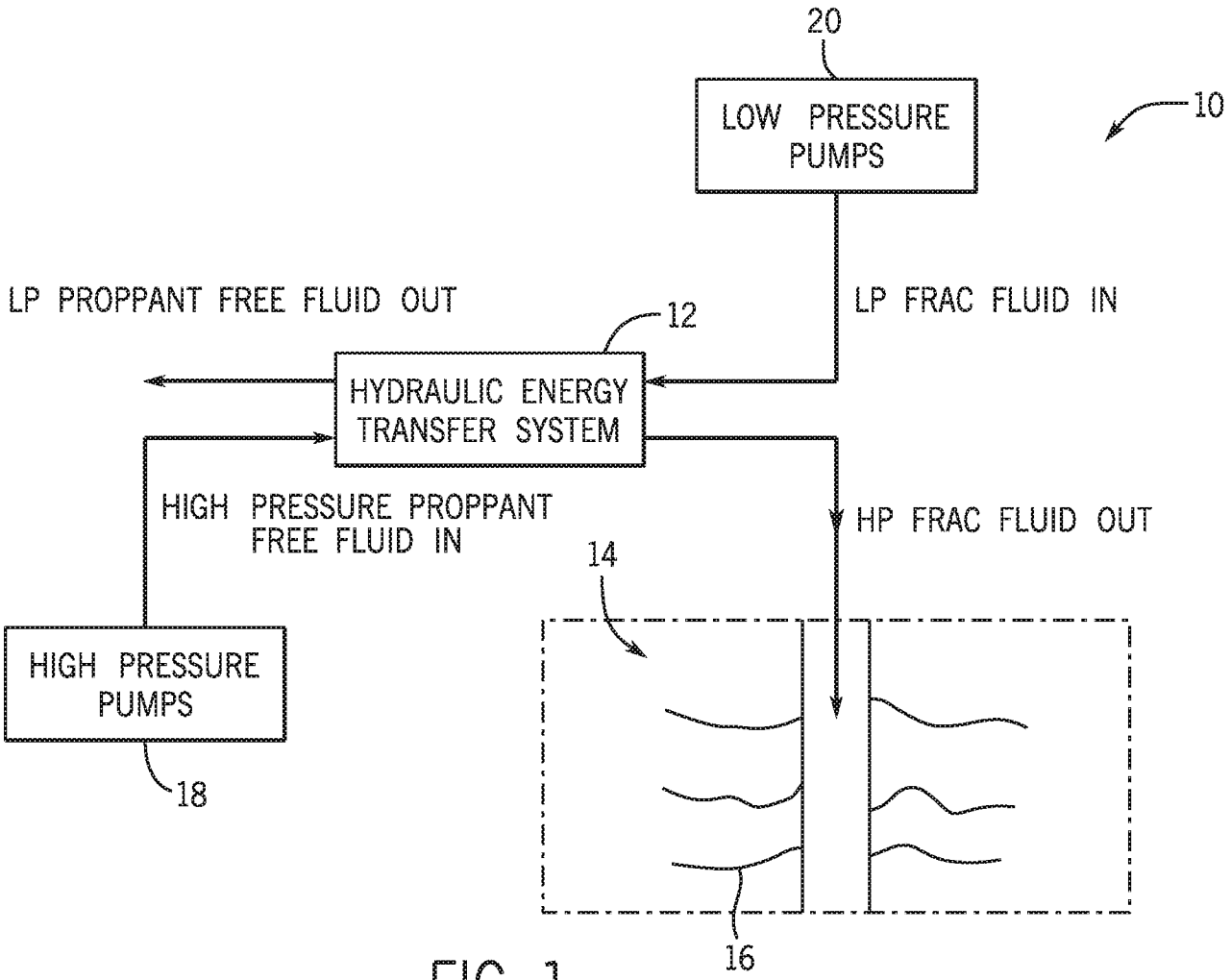
FIG. 1 is a schematic diagram of an embodiment of a frac system with a hydraulic energy transfer system.

FIG. 1 is a schematic diagram of an embodiment of a frac system 10 (e.g., fluid handling system) with a hydraulic energy transfer system 12. For example, during well completion operations, the frac system 10 pumps a pressurized particulate laden fluid that increases the release of oil and gas in rock formations 14 by propagating and increasing the size of cracks 16 in the rock formations 14. In order to block the cracks 16 from closing once the frac system 10 depressurizes, the frac system 10 uses fluids that have solid particles, powders, debris, etc. that enter and keep the cracks 16 open.

In order to pump this particulate laden fluid into the rock formation 14 (e.g., a well), the frac system 10 may include one or more high pressure pumps 18 and one or more low pressure pumps 20 coupled to the hydraulic energy transfer system 12. For example, the hydraulic energy transfer system 12 may be a hydraulic turbocharger or an IPX (e.g., a rotary IPX). In operation, the hydraulic energy transfer system 12 transfers pressures without any substantial mixing between a first fluid (e.g., proppant free fluid) pumped by the high pressure pumps 18 and a second fluid (e.g., proppant containing fluid or frac fluid) pumped by the low pressure pumps 20. In this manner, the hydraulic energy transfer system 12 blocks or limits wear on the high pressure pumps 18, while enabling the frac system 10 to pump a high-pressure frac fluid into the rock formation 14 to release oil and gas. In order to operate in corrosive and abrasive environments, the hydraulic energy transfer system 12 may be made from materials resistant to corrosive and abrasive substances in either the first and second fluids (e.g., wear-resistant materials, such as corrosion, erosion, and/or abrasion resistant materials). For example, the hydraulic energy transfer system 10 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

As used herein, the isobaric pressure exchanger (IPX) may be generally defined as a device that transfers fluid pressure between a high-pressure inlet stream and a low-pressure inlet stream at efficiencies in excess of approximately 50%, 60%, 70%, 80%, 90%, or more without utilizing centrifugal technology. In this context, high pressure refers to pressures greater than the low pressure. For example, the first fluid may be at a first pressure between approximately 5,000 kPa to 25,000 kPa, 20,000 kPa to 50,000 kPa, 40,000 kPa to 75,000 kPa, 75,000 kPa to 100,000 kPa or greater than a second pressure of the second fluid. The low-pressure inlet stream of the IPX may be pressurized and exit the IPX at high pressure (e.g., at a pressure greater than that of the low-pressure inlet stream), and the high-pressure inlet stream may be depressurized and exit the IPX at low pressure (e.g., at a pressure less than that of the high-pressure inlet stream). Additionally, the IPX may operate with the high-pressure fluid directly applying a force to pressurize the low-pressure fluid, with or without a fluid separator between the fluids. Examples of fluid separators that may be used with the IPX include, but are not limited to, pistons, bladders, diaphragms and the like. In certain embodiments, isobaric pressure exchangers may be rotary devices. Rotary isobaric pressure exchangers (IPXs), such as those manufactured by Energy Recovery, Inc. of San Leandro, Calif., may not have any separate valves, since the effective valving action is accomplished internal to the device via the relative motion of a rotor with respect to end covers. Rotary and IPXs may be designed to operate with internal pistons to isolate fluids and transfer pressure with relatively little mixing of the inlet fluid streams. Reciprocating IPXs may include a piston moving back and forth in a cylinder for transferring pressure between the fluid streams. Any IPX or plurality of IPXs may be used in the disclosed embodiments, such as, but not limited to, rotary IPXs, reciprocating IPXs, or any combination thereof. In addition, the IPX may be disposed on a skid separate from the other components of a fluid handling system, which may be desirable in situations in which the IPX is added to an existing fluid handling system.

Figure 2:
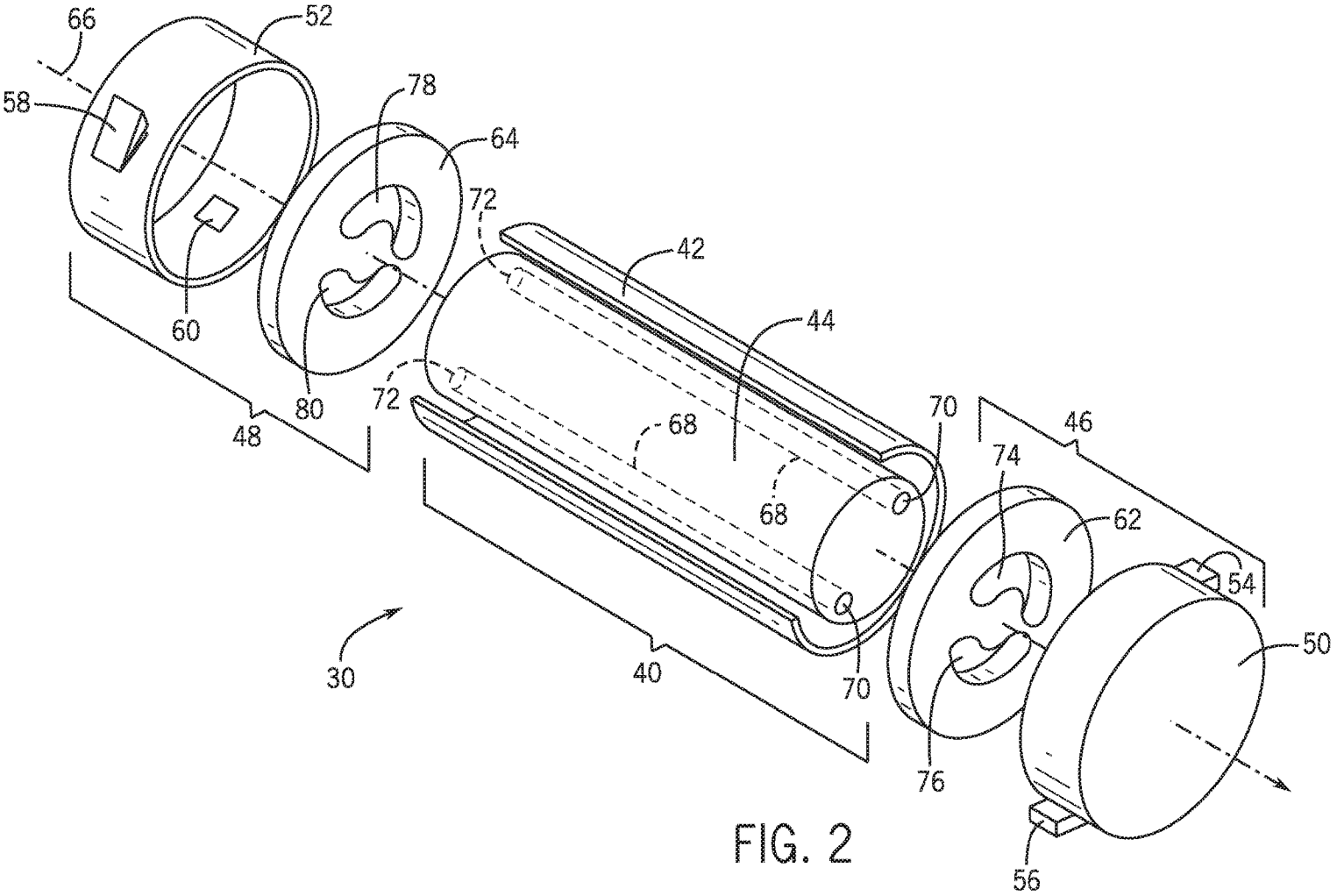
FIG. 2 is a perspective view of an embodiment of a rotary isobaric pressure exchanger (IPX)
Figure 3:
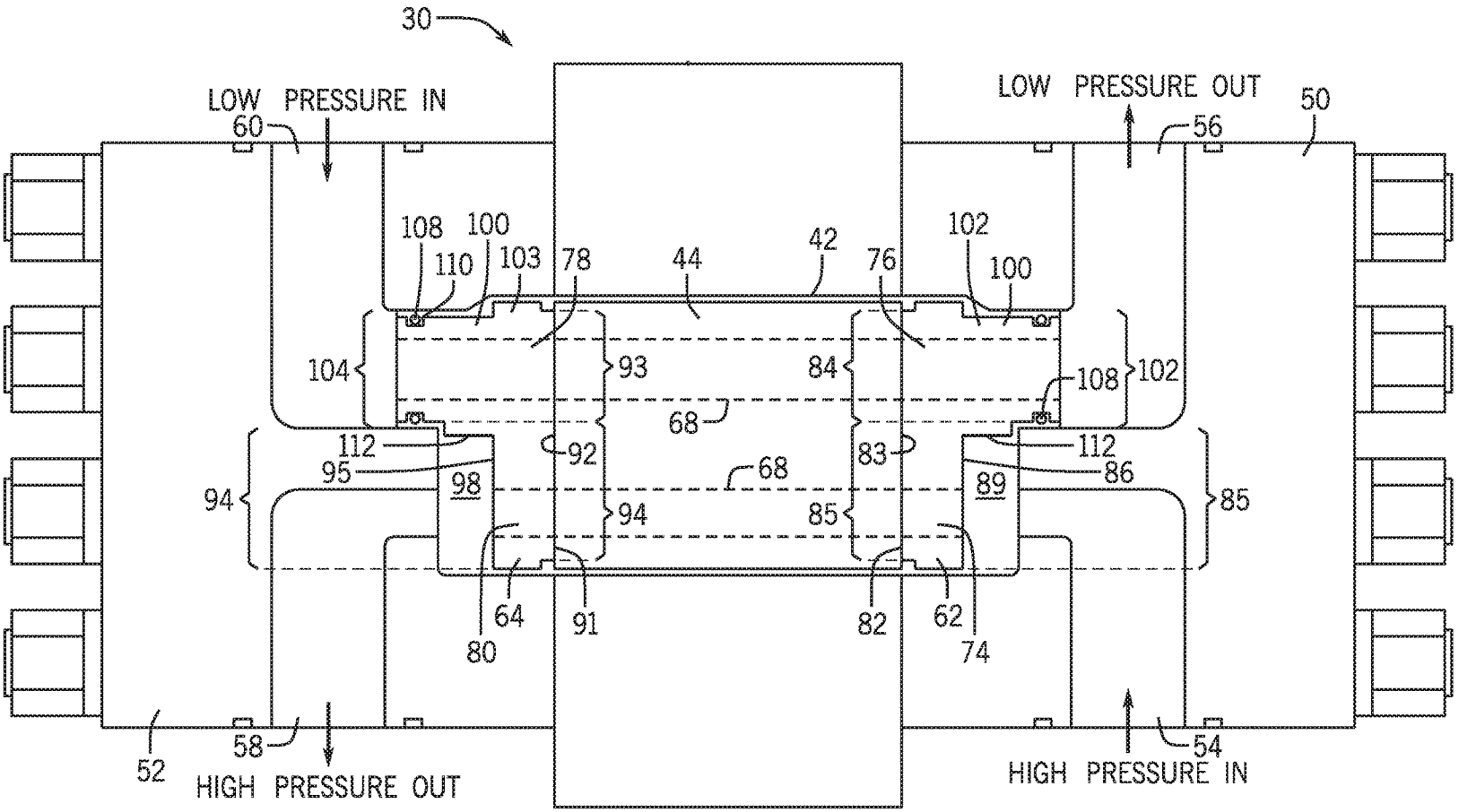
FIG. 3 is a schematic view of an embodiment of a piston integral with an end cover of a rotary IPX.

FIG. 2 is an exploded view of an embodiment of a rotary IPX 30. In the illustrated embodiment, the rotary IPX 30 may include a generally cylindrical body portion 40 that includes a housing 42 and a rotor 44. The rotary IPX 30 may also include two end structures 46 and 48 that may include manifolds (e.g., end caps) 50 and 52, respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the IPX 30. Similarly, inlet port 60 may receive a low-pressure second fluid and the outlet port 58 may be used to route a high-pressure second fluid away from the IPX 30. The end structures 46 and 48 include generally flat end covers (e.g., end covers) 62 and 64, respectively, disposed within the manifolds 50 and 52, respectively, and adapted for fluid sealing contact with the rotor 44.

The rotor 44 may be cylindrical and disposed in the housing 42, and is arranged for rotation about a longitudinal axis 66 of the rotor 44. The rotor 44 may have a plurality of channels 68 extending substantially longitudinally through the rotor 44 with openings 70 and 72 at each end arranged symmetrically about the longitudinal axis 66. The openings 70 and 72 of the rotor 44 are arranged for hydraulic communication with the end covers 62 and 64, and inlet and outlet apertures 74 and 76, and 78 and 80, in such a manner that during rotation they alternately hydraulically expose fluid at high pressure and fluid at low pressure to the respective manifolds 50 and 52. The inlet and outlet ports 54, 56, 58, and 60, of the manifolds 50 and 52 form at least one pair of ports for high-pressure fluid in one end element 46 or 48, and at least one pair of ports for low-pressure fluid in the opposite end element 48 or 46. The end covers 62 and 64 and inlet and outlet apertures 74 and 76, and 78 and 80 are designed with perpendicular flow cross sections in the form of arcs or segments of a circle.

As noted above, the inlet port 54 of the manifold 50 may receive a high-pressure first fluid and the outlet port 56 of the manifold 50 may be used to route a low-pressure first fluid away from the IPX 30. Similarly, inlet port 60 of the manifold 52 may receive a low-pressure second fluid and the outlet port 58 of the manifold 52 may be used to route a high-pressure second fluid away from the IPX 30. Additionally, the inlet port 54 may route the high-pressure first fluid to the inlet aperture 74 (e.g., first fluid inlet, high-pressure first fluid inlet) of the end cover 62, and the outlet port 56 may route the low-pressure first fluid from the outlet aperture 76 (e.g., first fluid outlet, low-pressure first fluid outlet) of the end cover 62. Further, the inlet port 60 may route the low-pressure second fluid to the inlet aperture 78 (e.g., second fluid inlet, low-pressure second fluid inlet) of the end cover 64, and the outlet port 58 may route the high-pressure second fluid away from the outlet aperture 80 (e.g., second fluid outlet, high-pressure second fluid outlet) of the end cover 64. The high-pressure and low-pressure fluids flowing to and from the end covers 62 and 64 may cause a pressure differential across the end covers 62 and 64, which may cause undesirable deflection of the end covers 62 and 64. Accordingly, it may be desirable to provide pressure balancing techniques, as described below, for the end covers 62 and 64 to minimize deflection.

Figure 4:
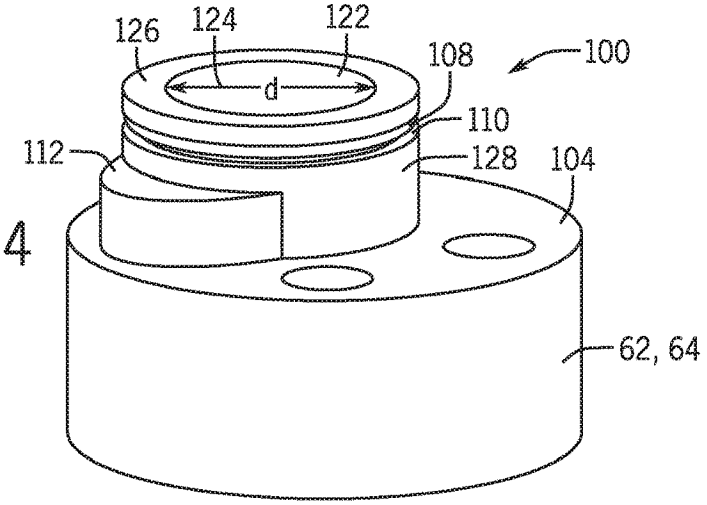
FIG. 4 is a perspective view of the integral piston and end cover of FIG. 3.

FIG. 4 is a cross-sectional view of an embodiment of the rotary IPX 30 that includes one or more pressure balancers, pressure-isolation sleeves (e.g., pistons) 100 configured to correct the pressure imbalance, as described above, across the end covers 62 and 64. The piston 100 may create a sealed off low pressure area to balance the forces on the respective end cover, which may minimize deflection of the respective end cover. For example, a first surface 82 (e.g., an axial surface) of the end cover 62 that interfaces with a first axial end 83 of the rotor 44 may be exposed to pressures from the low-pressure first fluid (e.g., a low-pressure clean fluid) and the high-pressure first fluid (e.g., a high-pressure clean fluid) disposed within the channels 68 and/or within an interface region between the first surface 82 of the end cover 62 and the first axial end 83 of the rotor 44. In particular, the first surface 82 may include a first low-pressure area 84 due to the low-pressure first fluid and a first high-pressure area 85 due to the high-pressure first fluid. Additionally, the first high-pressure area 85 may be disposed proximate to a second surface 86 (e.g., an axial surface) of the end cover 62 opposite from the first surface 82 due to the high-pressure first fluid within a high-pressure inlet chamber 89. To balance the forces on the end cover 62, a first piston 101 of the one or more pistons 100 may be integral with (e.g., manufactured as a single piece, adhesively coupled to, brazed to, welded to, bonded to, fused to, etc.) the second surface 86 (e.g., an axial surface) of the end cover 62. The first piston 101 may create a sealed off low pressure area 102 that may be approximately (e.g., within 10%, 9%, 8%, 7%, 6%, 5%, 4%, 3%, 2%, 1%, or less) the same size (e.g., area) as the first low-pressure area 84 about the first surface 82 of the end cover 62. The pressure of the sealed off low pressure area 102 may be based on the pressure of the low-pressure first fluid flowing through the first piston 100. By creating the sealed off low pressure area 102 that is approximately the same size as the first low-pressure area 84, the pressure differential across the end cover 62 may be reduced or minimized, which may reduce or minimize deflection of the end cover 62. Additionally, the first piston 101 may also separate the low-pressure first fluid from the high-pressure inlet chamber 89 and from the high-pressure first fluid. In particular, the IPX 30 may not operate efficiently or operate at all without separating the low-pressure first fluid from the high-pressure first fluid in the high-pressure inlet chamber 89.

Additionally, a first surface 91 (e.g., an axial surface) of the end cover 64 that interfaces with a second axial end 92 of the rotor 44 may be exposed to pressures from the low-pressure second fluid and the high-pressure second fluid disposed within the channels 68 and/or within an interface region between the first surface 91 of the end cover 64 and the second axial end 92 of the rotor 44. In particular, the first surface 91 may include a first low-pressure area 93 due to the low-pressure second fluid and a first high-pressure area 94 due to the high-pressure second fluid. Additionally, the second high-pressure area 94 may be disposed proximate to a second surface 95 (e.g., an axial surface) of the end cover 64 opposite from the first surface 91 due to the high-pressure second fluid within a high-pressure outlet chamber 98. To balance the forces on the end cover 64, a second piston 103 of the one or more pistons 100 may be integral with (e.g., manufactured as a single piece, adhesively coupled to, brazed to, welded to, bonded to, fused to, etc.) the end cover 64. The second piston 103 may create a sealed off low pressure area 104 that may be approximately (e.g., within 10%, 9%, 8%, 7%, 6%, 5%, 4%, 3%, 2%, 1%, or less) the same size (e.g., area) as the first low-pressure area 93 about the first surface 91 of the end cover 64. The pressure of the sealed off low pressure area 104 may be based on the pressure of the low-pressure second fluid flowing through the second piston 103. By creating the sealed off low pressure area 104 that is approximately the same size as the first low-pressure area 93, the pressure differential across the end cover 64 may be reduced or minimized, which may reduce or minimize deflection of the end cover 64. Additionally, the second piston 103 may also separate the low-pressure second fluid from the high-pressure outlet chamber 98 and from the high-pressure second fluid.

While the illustrated the first and second pistons 101 and 103 route low-pressure fluid and create sealed off low pressure areas 102 and 104, respectively, it should be appreciated that in some embodiments, the first and second pistons 101 and 103 may route fluids at any suitable pressures (e.g., high-pressure fluid) and may create sealed off areas of any suitable pressures (e.g., sealed off high-pressure areas). Additionally, in some embodiments, the IPX 30 may include more than the first and second pistons 101 and 103. For example, in some embodiments, the IPX 30 may include the illustrated first and second pistons 101 and 103 and may also include a third piston 100 to route the high-pressure first fluid and to create a sealed off high-pressure area and a fourth piston to route the high-pressure second fluid and to create a sealed off high-pressure area.

As noted above, the first piston 101 is integral with the end cover 62, and the second piston 103 is integral with the end cover 64. In some embodiments, the first piston 101 and end cover 62 may be manufactured as a single piece. Similarly, the second piston 103 and the end cover 64 may be manufactured as a single piece. In some embodiments, the pistons 101, 103 and the end covers 62, 64 may both be manufactured from a wear-resistant material, such as ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co. In some embodiments, the pistons 101, 103 may be manufactured separately from the end covers 62, 64 and may be later coupled to and/or integrated with the end cover 62, 64, respectively. For example, the first piston 101 and the end cover 62 may be re-fired in a kiln to fuse the first piston 101 and the end cover 62. In some embodiments, the pistons 101, 103 may be brazed to, welded to, adhesively coupled to, fused to, and/or bonded to the end covers 62, 64, respectively. Providing the integral pistons 101, 103 may provide increased reliability as compared to providing a piston that is coupled to the end cover 62, 64 (e.g., via a face seal. For example, a face seal configured to couple a piston to the end cover 62, 64 may separate due to pressure fluctuations, which may open clearance gaps between the end cover 62, 64 and the piston.

As illustrated, the first and second pistons 101 and 103 are disposed about the surfaces 86 and 95 of the end cover 62 and 64, respectively. The first and second pistons 101 and 103 may be disposed about any suitable location of the surfaces 86 and 95, respectively, such as the axial centers of the surfaces 86 and 95, respectively. Each piston 100 (e.g., the first piston 101, the second piston 103) includes one or more radial seals (e.g., seal rings) 108 within one or more grooves 110 (e.g., a circumferential groove) of the respective piston 100. The one or more radial seals 108 may be any suitable seal, such as, but not limited to, an O-ring, a square ring, an X-ring, U-ring, or the like. The piston 100 therefore may maintain a seal while axially moving within the bore of the housing's end cap (e.g., within the manifold 50 or the manifold 52). For example, the internal cavity of the housing (e.g., the manifold 50 and/or the manifold 52) may deflect due to pressure and/or temperature induced expansion. Further, each piston 100 (e.g., the first and second pistons 101 and 103) may include a wing 112 (e.g., a shelf), which will be described in more detail below that extends radially from the respective piston 100.

Figure 5:
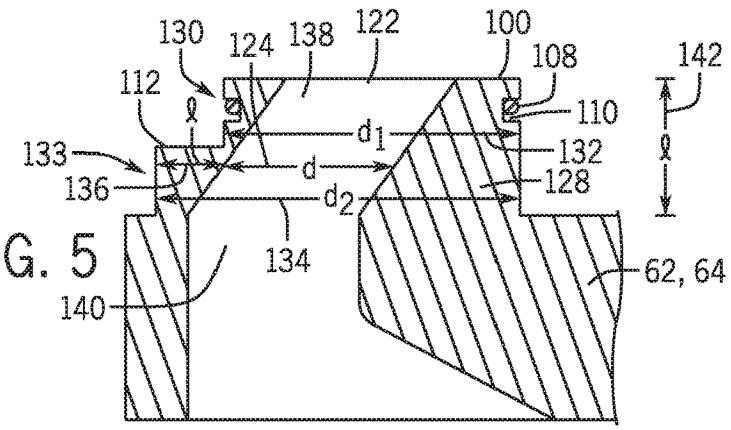
FIG. 5 is a cross-sectional view of an embodiment of a piston integral with an end cover of a rotary IPX.

FIG. 5 is a perspective view of an embodiment of the piston 100 (e.g., the first piston 101 or the second piston 103) that is integral with an end cover (e.g., the end cover 62 or 64). The piston 100 includes an aperture 122 (e.g., a hydraulic flow path). The aperture 122 provides a hydraulic flow path that directs the incoming low pressure fluid to the low pressure inlet of the end cover 64 or directs the outgoing low pressure fluid from the low pressure outlet of the end cover 62. The aperture 122 includes a diameter 124 at the top surface 126 of the piston 100, which may be selected based upon the diameter of the low pressure inlet or outlet. The diameter of the aperture 122 may be constant or may vary throughout the hydraulic flow path. That is, the diameter 124 of the aperture 122 (e.g., the diameter 124 of the hydraulic flow path) may be constant over the length of the hydraulic flow path through the piston 100 or may vary over the length of the hydraulic flow path through the piston 100. The piston also includes the one or more radial seals 108 disposed in the one or more circumferential grooves 110 of the piston 100. As noted above, the one or more radial seals 108 may maintain a seal with the housing or end cap (e.g., manifold 50, manifold 52) as the end cover (e.g., end cover 62, 64) moves axially due to temperature and/or pressure induced expansion, contraction, and deflection.

The wing 112 extends radially outward from the piston 100. As illustrated, the wing 112 may be disposed about a portion of a body 128 (e.g., a generally cylindrical body) of the piston 100. That is, the wing 112 may not extend about the entire circumference of the body 128 of the piston 100. In other embodiments, the wing 112 may be disposed about the entire circumference of the piston 100. The wing 112 may be generally conical, frustoconical, cylindrical, or any other suitable shape. In some embodiments, the wing 112 may facilitate brazing, fusing, welding, and/or adhesively bonding, the piston 100 to the end cover 62 or 64 by providing additional surface area for coupling. Additionally, the wing 112 may facilitate room for the hydraulic flow path. In some embodiments, the piston 100 may not include the wing 112. In some embodiments, the piston 100 may include more than one wing 112 (e.g., 2, 3, 4, or more).

Figure 6:
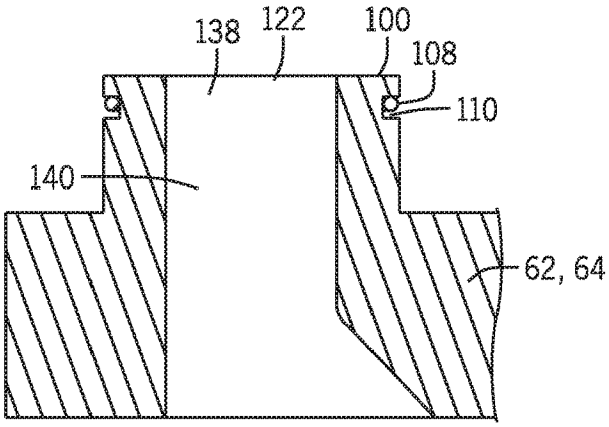
FIG. 6 is a cross-sectional view of an embodiment of a piston integral with an end cover of a rotary IPX.

FIG. 6 is a cross-sectional view of the piston 100 that is integral with an end cover (e.g. the end cover 62 or 64). As illustrated, an upper portion 130 of the piston has a diameter 132 (e.g., $d_1$) and the wing 112 of the piston 100 has a length 134 (e.g., $d_2$) that is greater than the diameter 132. In particular, the length 134 may be greater than the diameter 132 by a length 136 (e.g., $d_3$). The wing 112 may provide additional volume and surface area for the piston 100 that may enable a hydraulic flow path 138 through the piston 100 to be formed in a desired manner. For example, the aperture 122 may not be centered (e.g., axially aligned) about an aperture 140 (e.g., the inlet 74, outlet 76, inlet 78, or outlet 80) of the end cover 62 or 64. By providing the wing 112, the piston 100 may include additional volume and surface area to enable the hydraulic flow path 138 to be formed (e.g., angled) in a desired manner from the aperture 122 to the aperture 140 of the end cover 62 or 64. Thus, the hydraulic flow path 138 may be continuous through the aperture 140 and may be minimally obstructed (e.g., may not experience sharp changes in direction) through the aperture 140.

As illustrated, the aperture 122 and the hydraulic flow path 138 may vary in diameter 124 (e.g., along a length 142 of the hydraulic flow path through the piston 100), which may help direct the incoming or outgoing low pressure fluid to the aperture 140 of the end cover 62 or 64. The hydraulic flow path 138 may define a sealed off low pressure area 144 (e.g., the second low-pressure area 87, the second low-pressure area 96). The pressure of the sealed off low pressure area 144 may be determined based on the pressure of the incoming/outgoing low pressure fluid. Further, as described in detail above, the sealed off low pressure area 144 may balance the forces on the respective end cover 62 or 64 to minimize the deflection of the end cover 62 or 64. Additionally, as noted above, the piston 100 may be manufactured from one or more wear-resistant materials, such as, but not limited to, tungsten carbide, ceramics, steel, etc., which may enable the piston 100 to withstand external pressures exerted on the piston 100.

Figure 7:
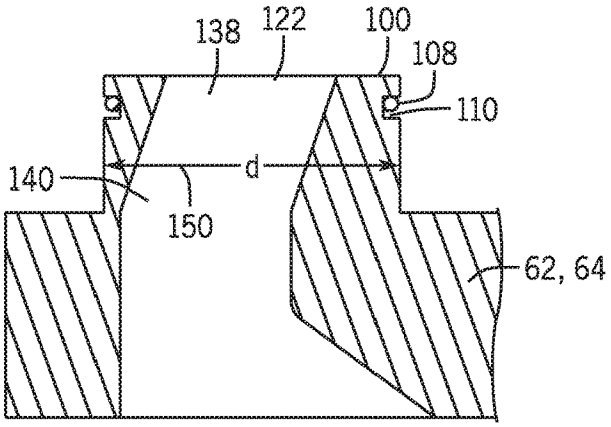
FIG. 7 is a cross-sectional view of an embodiment of a piston integral with an end cover of a rotary IPX.

While the above embodiment relates a piston including a wing, in other embodiments, the piston 100 may not include the wing 112. For example, as illustrated in FIG. 7, which is a cross-sectional view of an embodiment of the piston 100, the aperture 122 of the piston 100 may be centrally aligned (e.g., axially aligned) with the aperture 140 of the end cover 62 or 64. Because of the alignment of the apertures 122 and 140, the hydraulic flow path 138 may include a continuous and unobstructed pathway through the apertures 122 and 140 without providing the wing 112. However, in some embodiments, the wing 112 may still be provided. For example, the wing 112 may facilitate the integration of the piston 100 to the end cover 62 or 64 during re-firing or brazing. Further, the wing 112 may not be included on the piston 100 for embodiments in which the apertures 122 and 140 are centrally aligned. For example, as illustrated in FIG. 8, the diameter 150 of the piston 100 may be sufficient such that the hydraulic flow path 138 may be angled toward the aperture 140 of the end cover 62 or 54 without the need for the additional volume provided by the wing 112.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system comprising:

a rotary isobaric pressure exchanger (IPX) configured to exchange pressures between a first fluid and second fluid, wherein the rotary IPX comprises:

a first end cover comprising a first fluid aperture configured to route the first fluid;

a first piston coupled to the first end cover, wherein the first piston defines a first hydraulic path configured to route the first fluid to or from the first fluid aperture, and wherein the first piston comprises a wing that extends radially outward from and about a portion of a body of the first piston, wherein the portion is less than the entire circumference of the body;

a second end cover comprising a second fluid aperture configured to route the second fluid; and a second piston coupled to the second end cover, wherein the second piston comprises a second hydraulic path configured to route the second fluid to or from the second fluid aperture.

2. The system of claim 1, wherein the rotary IPX comprises a rotor having a first axial end and a second axial end, and wherein the first end cover comprises a first axial surface that interfaces with the first axial end, and wherein the second end cover comprises a second axial surface that interfaces with the second axial end.

3. The system of claim 2, wherein the first piston is coupled to a third axial surface of the first end cover that is disposed opposite from the first axial surface, and wherein the second piston is coupled to a fourth axial surface of the second end cover that is disposed opposite from the second axial surface.

4. The system of claim 1, wherein the first end cover and the first piston are manufactured as a single piece.

5. The system of claim 1, wherein the first piston is brazed or adhesively bonded to the first end cover.

6. The system of claim 1, wherein the first hydraulic path is configured to route the first fluid at low pressure to or from the first fluid aperture.

7. The system of claim 1, wherein the first hydraulic path is configured to route the first fluid at high pressure to or from the first fluid aperture.

8. The system of claim 1, wherein the first piston is configured to separate the first fluid at low pressure from the first fluid at high pressure, and the second piston is configured to separate the second fluid at low pressure from the second fluid at high pressure.

9. The system of claim 1, wherein the first end cover is disposed within a first manifold of the rotary IPX, and wherein the first piston comprises a first seal ring configured to maintain a seal with the first manifold.

10. The system of claim 1, wherein the wing is coupled to the first end cover.

11. The system of claim 1, wherein a diameter of the first or second hydraulic path varies over a length of the first or second hydraulic path.

12. A system, comprising:

a rotary isobaric pressure exchanger (IPX) configured to exchange pressures between a first fluid and a second fluid, wherein the rotary IPX comprises:

a first manifold defining a first cavity, a first port, and a second port, wherein the second port is in fluid communication with the first cavity;

a first end cover disposed in the first cavity of the first manifold, wherein the first end cover comprises a first aperture; and a first piston coupled to the first end cover, wherein the first piston comprises:

a first hydraulic path configured to route the first fluid to or from the first aperture of the first end cover; and a first seal ring configured to maintain a seal with the first manifold.

13. The system of claim 12, wherein the first hydraulic path is configured to route the first fluid at low pressure to or from the first aperture of the first end cover.

14. The system of claim 12, wherein the rotary IPX comprises:

a second manifold;

a second end cover disposed in the second manifold, wherein the second end cover comprises a second aperture; and a second piston coupled to the second end cover, wherein the second piston comprises:

a second hydraulic pathway configured to route the second fluid to or from the second aperture; and a second seal ring configured to maintain a seal with the second manifold.

15. The system of claim 12, wherein the first piston and the first end cover are manufactured as a single piece.

16. The system of claim 12, wherein the first piston comprises one or more wings that extend radially outward from a body of the first piston, and wherein the one or more wings are coupled to the first end cover.

17. The system of claim 12, wherein the first piston is adhesively bonded to the first end cover.

18. A system comprising:

a rotary isobaric pressure exchanger (IPX) configured to exchange pressures between a first fluid and second fluid, wherein the rotary IPX comprises:

an end cover comprising a first aperture defining a first angle with respect to a longitudinal axis of the end cover, the first aperture is configured to route the first fluid through the end cover; and a piston coupled to the end cover, wherein the piston defines a second aperture defining a second angle with respect to the longitudinal axis of the end cover, the second aperture is configured to route the first fluid to or from the first aperture, and wherein the second angle is an acute angle with respect to the longitudinal axis of the end cover.

19. The system of claim 18, wherein the first angle and the second angle are different.

20. The system of claim 18, wherein the first aperture defines a first portion having a third angle and a second portion with a fourth angle, and wherein the third angle and the fourth angle are different.

* * * * *